US006929551B1

(12) United States Patent
Ballmick

(10) Patent No.: US 6,929,551 B1
(45) Date of Patent: Aug. 16, 2005

(54) HORIZONTAL ROTATING AMUSEMENT SWING

(75) Inventor: Chandreka Persaud Ballmick, Etobicoke (CA)

(73) Assignee: Daywakie Ramalingum, Toronto ( * ) Notice: Subject to any disclaimer, the term of this patent is extended or adjusted under 35 U.S.C. 154(b) by 0 days.

(21) Appl. No.: 10/935,397

(22) Filed: Sep. 8, 2004

(51) Int. Cl.[7] ..... A63G 1/12
(52) U.S. Cl. ..... 472/21; 472/108
(58) Field of Search ..... 472/19–21, 27, 472/29, 33, 35, 32, 108; 248/188.7, 163.1

(56) References Cited

U.S. PATENT DOCUMENTS

| | | | | | |
|---|---|---|---|---|---|
| 1,494,299 | A | * | 5/1924 | Williams | 472/19 |
| 2,474,250 | A | * | 6/1949 | Howard | 52/114 |
| 2,680,616 | A | * | 6/1954 | Taylor et al. | 472/19 |
| 2,689,125 | A | * | 9/1954 | Wolbert | 472/19 |
| 2,699,335 | A | * | 1/1955 | Krueger, Jr. | 472/19 |
| 2,819,080 | A | * | 1/1958 | Pittaluga | 472/5 |
| 2,835,491 | A | * | 5/1958 | Meyers | 472/5 |
| 2,895,734 | A | * | 7/1959 | Pittaluga | 472/5 |
| 2,919,131 | A | * | 12/1959 | Dimitriadis | 472/5 |
| 3,339,919 | A | * | 9/1967 | Jones | 472/19 |
| 3,758,108 | A | * | 9/1973 | Tada | 472/5 |
| 5,639,056 | A | * | 6/1997 | Mecalf | 248/523 |
| 5,885,163 | A | * | 3/1999 | Bjorn et al. | 472/5 |
| 5,921,867 | A | * | 7/1999 | Mayeux | 472/19 |

* cited by examiner

*Primary Examiner*—Kien Nguyen

(57) ABSTRACT

An amusement swing apparatus for children and adults alike and more particularly, a horizontal rotating manually operated swing. It can be conceptualized as two seesaws lapped in the middle at right angles, but instead of the riders going up and down, they remain in a horizontal plane and rotates about the centre point. Where these beams cross at the middle, they are supported on a housing that carries two bearings, one on top of the housing and one at the bottom. This housing is fitted to a vertical shaft that passes through the centre of the lapped beams and allows the housing with the lapped beams to rotate freely around it. The shaft is firmly fixed to the ground or floor surface. Four or six legs, attached to a flange welded to the shaft add support to the structure. These legs spread out evenly around the flange and are fixed to the ground or floor surface.

The four outer ends of the beams have seats for persons to sit on. At the top of the centre shaft is a short vertical pin that is placed offset by a flat plate in the shape of a cam. This cam shaped plate is attached to the top of the centre shaft by means of a boss. The boss is welded to the bottom of the larger side of the cam-shaped plate.

Fixed on the underside of each of the lapped beams, at the outer ends near to where each person sits, are footrest frames. Directly above these footrests are handle frames that are hinged to the beams and have a handle for each rider to hold on to with both hands. These handle frames are free to move forward and backwards. Each handle frames have a short cross pin to which the connecting rods are hinged. The other ends of these connecting rods are hinged to the vertical offset pin with interconnecting short knuckle linkages. These short linkages have two rings at each end that are turned horizontal and vertical.

Any one out of the four riders can operate the swing. By grabbing the handles and moving them forward and backward creates a translation force on the frame to allow the rider to start rotate around the centre pivotal point.

18 Claims, 4 Drawing Sheets

HORIZONTAL ROTATING AMUSEMENT SWING

BACKGROUND OF THE INVENTION

Playground and backyard swings are a common source of recreation, enjoyment and relaxation for children and adults. Swings are of many sorts and may be nothing more than a piece of flat board suspended from a tree branch with two ropes tied to its ends; or a used automobile tire suspended from a tree branch.

It is quite common to use electrically, mechanically actuated or manually powered swings for the amusement of children. These include non-electric swings and a number of AC motor-operated or battery-operated swing types. However, AC motor-operated swings are undesirable for children's use for a number of reasons. Because they operate off a standard AC power source with high voltages, they are not desired where children are concerned. Furthermore, being AC driven, such swings require line cords, which limits its portability and present potential hazards to children in the vicinity. Moreover, the use of an AC motor adds considerable weight to the item; thereby increasing it's manufacturing and shipping cost. The use of an AC motor does not lend itself well to the sale of the item in "knockdown" form since the customer would ultimately be the one to assemble/disassemble.

There are sophisticated models of swings that can be used domestically and others that are used commercially. Swings would allow its rider/s to move in circular rotational, reciprocating, rocking, oscillating (pendulum) motions, based on their specific designs. Many types have been designed to act upon by gravity forces due to inertia of the riders while others has been made to work as motorized or spring loaded. In all cases, once motion is attained by the physical efforts of the rider, or by motor, or by spring, or with the assistance of an individual pushing the swing, simulating the reduction of gravity to a rider, the swing apparatus will provide hours of fun and amusement. Children just love to have a thrill ride.

None prior art patents disclose a swing of the present design which is safe, convenient, easily operated, easily assembled and disassembled for storage (if the need be) and also for transportation from one place to another.

SUMMARY OF THE INVENTION

Over the years, swings that can rotate horizontally have been seen in amusement parks that are commercially operated. It may be appreciated that there is an evident need to provide a swing that can be placed in every child's backyard. That is, a swing that is affordable for parents to provide for their child or children and simple in construction. At the same time also a swing that can be used by the entire family, something that will provide amusement for father, mother, children, children's friends and neighbors.

So far we've seen swing ride of the similar type that causes their riders to go around and even go around in the cubicle/pocket of their seats while the swing raises the riders up and down. These are very large structures that can only be generally used commercially. They are motor driven and have a hydraulic system, which also have to be powered with an electric motor.

The present invention is totally mechanical and is manually operated, and as such there is no need for the supply of electricity. The swing can therefore be used in an open field, a play park or even in a balcony or any place where it can be assembled completely and fixed to the ground or level floor surface.

The principle of operation of this present invention is similar to the operation of an outboard engine, or for than matter any combustion engine. In this case, the pistons are the rocker arms which the rider/s push/pull. The vertical shaft with the crankpin fixed to it is representative to the engine crankshaft. The bearing frame with the two seating members makes up the engine block.

The analogy here is the same except that as in the case of the outboard engine, the movement of the piston causes the crankshaft to turn. Here the crankshaft is fixed to the ground so the motion is transferred to the block instead. The driving force is not an explosion/expansion of gases as in the case of the combustion engine but it is the pulling and pushing of the individual riders.

It is therefore an object of the present invention to provide a swing that can be used by one or up to four persons from ages three and above. Infants that can sit upright when properly strapped in their seat can be riders only and not partake in the driving of the swing, i.e., one and two year old.

Another object of the present invention is to provide a swing that can be operated easily without being motorized or require electricity, battery or torsional springs to cause motion.

Yet another object of the present invention is to provide a swing that is safe to use and can be assembled and dissembled without any special tools or fixtures and can be done relatively easy.

Another object of the present invention is to provide a swing that is manually driven. Motion of this swing is caused by the translation of forces—cam action.

An even further object of the present invention is the elimination of the need to have someone to push the swing to have it started. This swing starts with the rider/s pushing and pulling on the driving handles.

Another object of the present invention is the elimination of the need for electrical power cables, which can be a source of severe danger to the rider/s and limits where the swing can be assembled for use. Also the cost factor for electricity is eliminated.

Yet another object of the present invention is to provide an amusement ride that can be enjoyed by a plurality of riders who may enjoy the thrill and excitement of riding together.

It is a further objective of the present invention to provide a swing apparatus that can be used indoors or outdoors and in all seasons.

It is yet another object of the present invention to provide a swing apparatus, which is economically affordable to the general public.

Another object of the present invention is to provide a swing whereby the riders control the speed. This will include the starting and stopping.

Still yet another object of the present invention is to provide a compact swing apparatus that is of a durable, safe and reliable construction.

Another object of the present invention is to provide a swing that is of low altitude and has a very low injury potential for its riders.

An even further object of the present invention is to provide a swing apparatus that does not place any stress on the bodies of the riders.

These together with other objects of the invention, along with the various features of novelty that characterize the invention, are pointed out in particularity in the claims annexed to and forming a part of this disclosure. For a better understanding of the invention, its operating advantages and the specific objects attained by its design and use, reference should be made to the accompanying drawings and descriptive matter in which there are illustrated preferred embodiments of the invention.

BRIEF DESCRIPTION OF THE SEVERAL VIEWS OF THE DRAWINGS

The invention will be better appreciated while objects, advantages, practical application and capabilities other than those set forth above will become apparent when consideration is given to the following detailed description and accompanying drawings wherein.

DETAILED DESCRIPTION OF THE INVENTION

Figure 1:
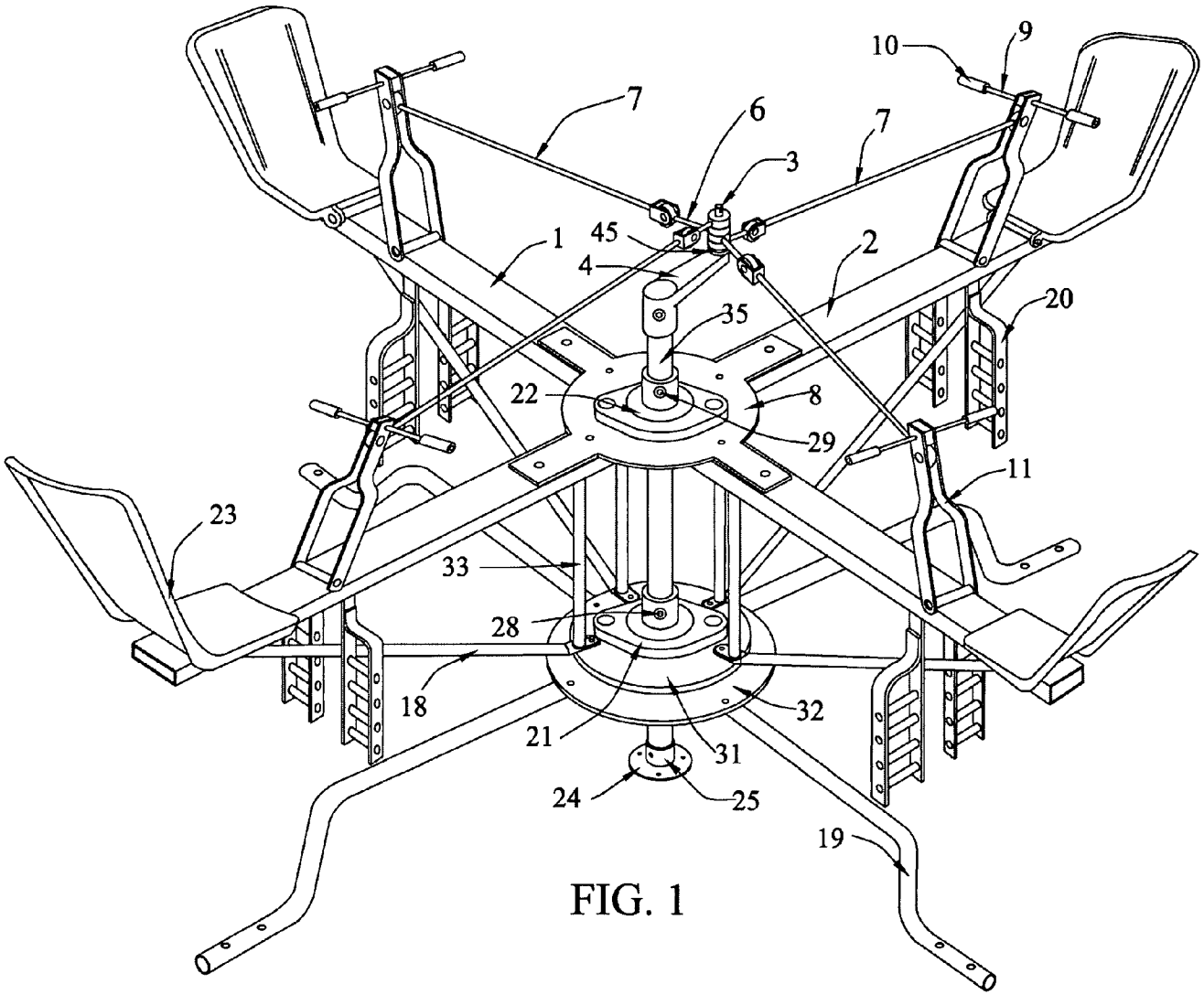
FIG. 1 is an isometric view illustrating the subject invention.
Figure 3:
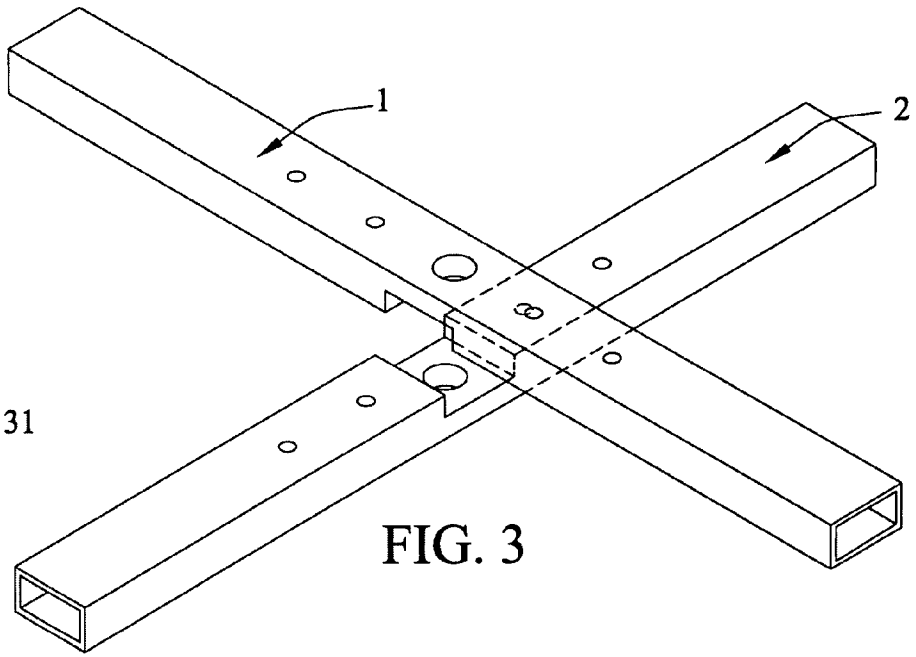
FIG. 3 is an isometric view illustrating the two lapped beams.

For the purpose of illustrating the invention, there is shown in the drawings a form that is presently preferred. It should be understood, however, that this invention is not limited to the precise arrangements and instrumentality shown.

In the figures, identical reference numerals are used to indicate corresponding parts.

Figure 2:
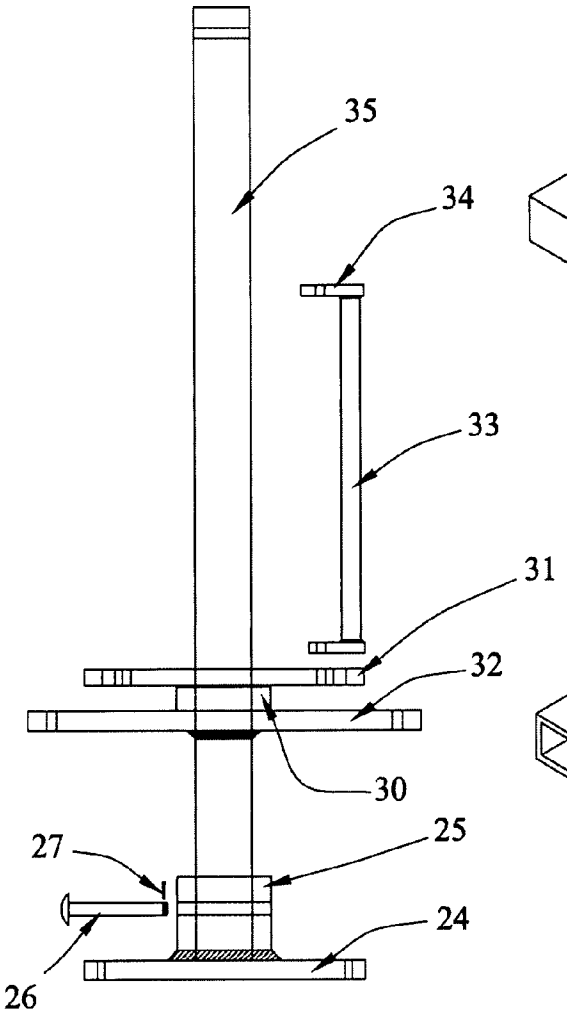
FIG. 2 is the front elevation illustrating the main centre shaft with base support and one of the four centre-hub assembly supports.
Figure 4:
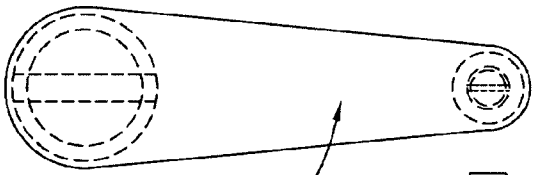
FIG. 4 is a plan view illustrating the crank which is a cam-shaped plate having a boss welded to the bottom of the large end and the offset pin (crankpin) passing vertically through the small end and welded at the bottom.

Referring to the accompanying drawings, FIG. 2 illustrates a flange 32 welded at the bottom onto the main centre shaft 35. The boss 25 is welded on to flange 24 to form the base support unit for the vertical centre shaft. This unit is pinned to the bottom of the shaft, using pin 26 with split pin 27. This unit serves to support the vertical centre shaft to the ground surface. Large spike nails are used through the holes in flange 24 to firmly fix the shaft 35 to the ground surface or other level surface and prevents it from rotating about its centre.

A spacer ring 30 is slipped onto the centre shaft and rests on flange 32. The purpose for this spacer is to prevent the bolt heads that will be passing through flange 31 to be touching flange 32.

The two main beams 1 & 2 are lapped in the middle with reinforcement plate 8 bolted on to them using the bolt holes at the outer ends of the reinforcement plate. Bearing 22 rest on top of plate 8 and is bolted at both ends.

Two little flat flange pieces 34 are welded to the ends of piece 33 to form a single support piece. The top flange of these support pieces are bolted to plate 8, using the inner bolt holes on plate 8. These bolts pass through the main beams also. Four or six of these support pieces can be used. Piece 33 may be formed from metal tube.

Obliquely mounted support braces 18 may be formed from metal tubes that have their two ends flattened with bolt holes in each. The bottom of this support member is bolted between the bottom flange of vertical support 33 and to flange plate 31. The top flat of brace support 18 is bolted to the beams under the seats 23. Bearing 21 is bolted to flange plate 31. The bearings 21 & 22 are locked to the centre shaft using grub screws 28 & 29 that are on the inner race of the bearings. This allows the rest of the frame to rotate freely. Bearings 22 and 21 are of mounted deep groove radial ball bearings type.

Legs 19 may be formed from metal tubes with their top ends flattened to take bolt holes. The top of the legs is bolted to the flange plate 32. The lower ends rest onto the ground surface and through the holes drilled in its centre are pinned down using spike nails.

The handle frames are made of two curved shaped metal flats 11 with spacer pieces 41 welded in the middle. Pieces 41 are square pieces of mild steel plate. Handles 9 pass through a holed drilled through the side pieces 11 and spacer pieces 41. The top centre of each spacer piece 41 carries a threaded hole. The handle rods 9 are fixed in the middle using set screws 17 through the threaded hole in the space pieces 41. Handle rods 9 can be formed from metal tube or bar. At the two ends of the handles 9 are slipped on handgrips 10. Depending where the swing is used, and if it is fixed in a back yard or needs to be moved from place to place, different methods can be used to fix the handgrips 10 in place. It can be grub screwed in position or they can be glued on permanently.

The upper portions of the side pieces of the handle frames are drilled to pass pins 15. These pins 15 along with split pins 16 are used for attaching the top rings of the connecting rods 7. The top rings of the connecting rods moves freely on pins 15. Fixing a piece of hollow tube 12 to the outer ends of each beam makes a part of the hinges for the handle frames. The open ends of the handle frames are drilled to pass pins 13. The flat side pieces of the handle frame is placed over the hollow tubes 12 and pins 13 are passed though the drilled holes on the flat sides and the hollow tubes on the beams to complete the hinges for the handle frames. Split pins 14 are inserted to the ends of the cross pins 13 to allow the handle frames to be free to move forward and backward.

Figure 5:
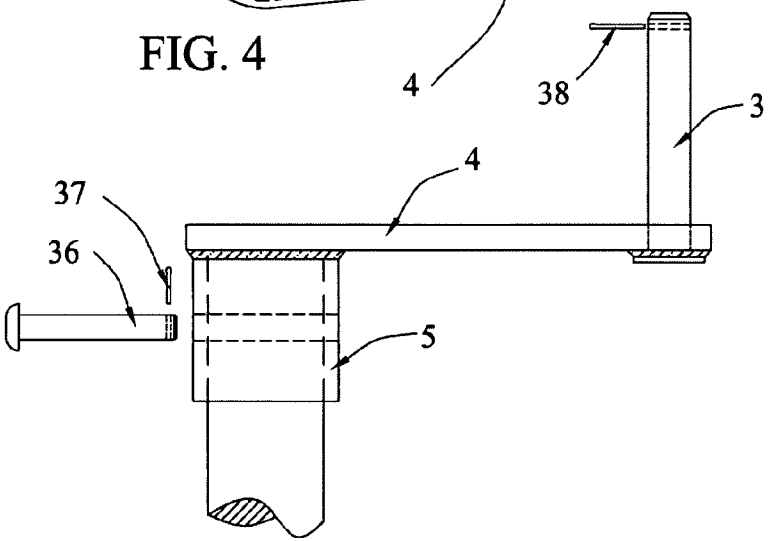
FIG. 5 is front view illustrating the boss at the top of the main centre shaft on to which is welded the cam shaped plate with offset pin. It also shows the fixing pin for the unit to the centre shaft.

FIG. 5 shows the offset crankpin 3 passing vertically through the small end of the cam shaped plate 4 and welded at the bottom. The other end of the cam shaped plate 4 is welded to boss 5. This forms a single piece that is pinned, using pin 36 and split pin 37, to the top of the centre shaft 35. Pin 36 is fitted snugly through the boss and shaft so that the unit does not have any movement when force is applied to crankpin 3 through the connecting rods 7.

Figure 6:
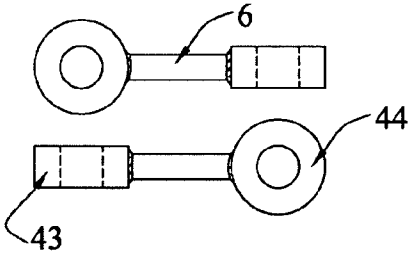
FIG. 6 is plan and front elevation illustration of the knuckle connecting linkage.

In FIG. 6, the knuckle connecting linkage consists of two rings welded at two ends of a short rod or tube. These rings are welded in two different planes, vertical and horizontal. A spacer ring 45 is slipped on to the crankpin 3 before inserting the horizontal rings 43 on the knuckle linkages and these are kept in place using split pin 38. The vertical rings 44 on the knuckle linkages are pinned to the yokes of the connecting rods 7 using pins 39 and split pins 40. All the short linkages are of the same length. The purpose of these short linkages is to give allowance or flexibility of movement to the connecting rods when they move forwards and backwards. As the connecting rods moves forwards and backwards, the point that is hinged to the handle frames will make the movement in the form of an arc.

Figure 7:
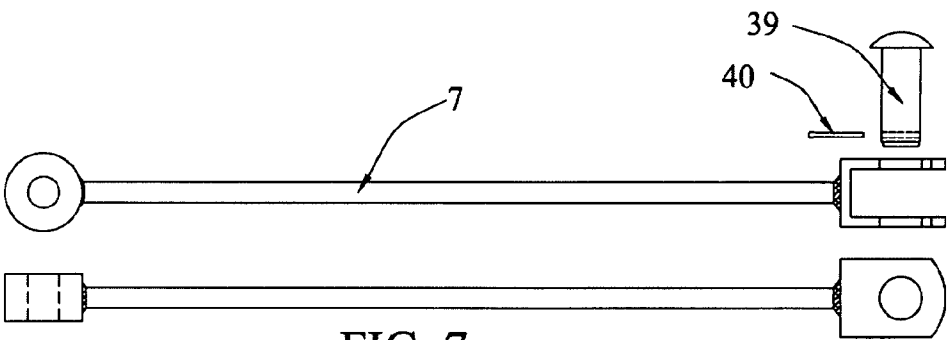
FIG. 7 is a plan and front view illustrating one of the connecting rods with fixing pin for knuckle connecting linkage.
Figure 10:
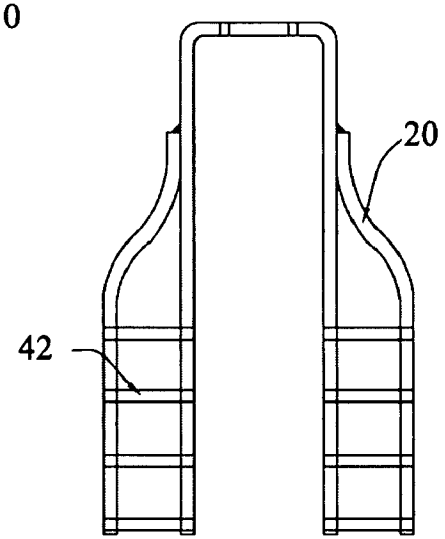
FIG. 10 is a front elevation illustration of one of the footrests.
Figure 9:
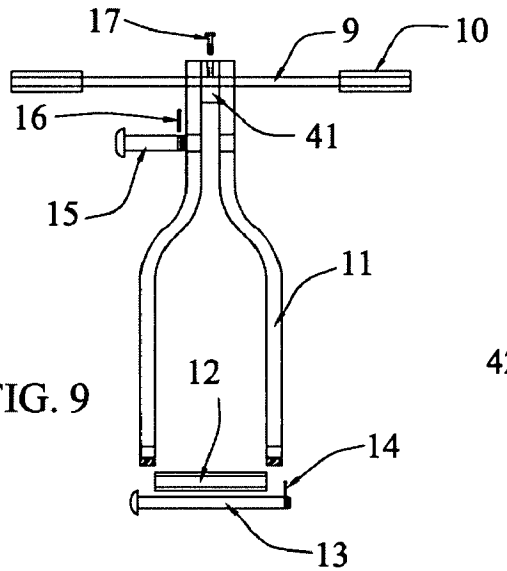
FIG. 9 is a front elevation illustration of one of the handle frame with hinge and connecting rod head pin.
Figure 8:
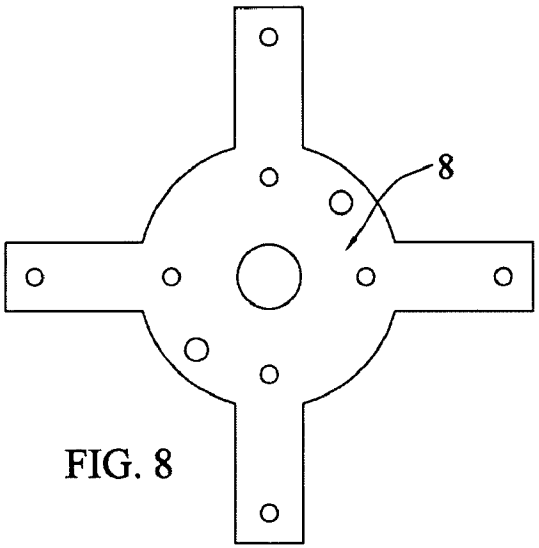
FIG. 8 is a plan view of the reinforcement plate, which holds the hub assembly, and the lapped seating beams together.
Figure 12:
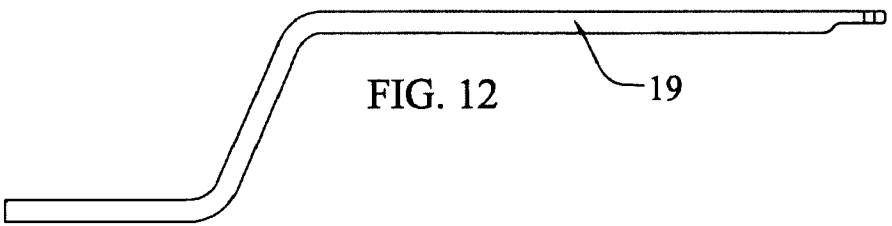
FIG. 12 is a front elevation illustration of one of the feet.
Figure 11:
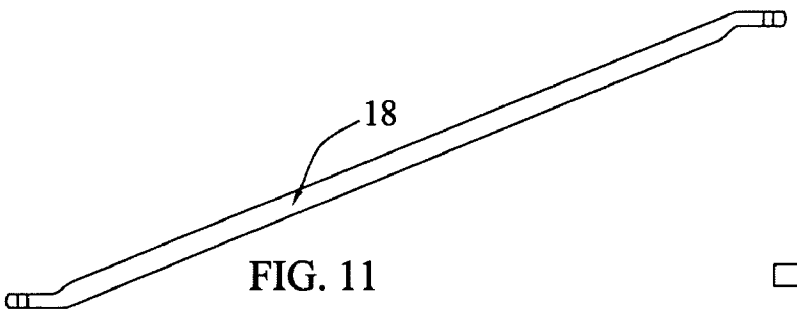
FIG. 11 is a front elevation illustration of one of the support braces.

FIG. 7 shows the connecting rod 7. This is formed from metal tube or solid rod. At one end is welded a ring while the other end is welded a yoke. The yoke is formed from a piece of flat plate. The yoke is drilled on both sides to accommodate pin 39. All the connecting rods are of the same length. The rings of the head of the connecting rods 7 are pinned to the rocker arms with pins 15 and split pins 16.

On the underside of the beams, just below where the handle frames are mounted, are bolted the footrests 20. Short pieces of hollow tubing or rods 42 are welded to the flat curved shaped side pieces at different levels to accommodate different sizes of riders.

The bucket seats 23 are made out of polymeric material and are mounted on the outer ends of the beams. These seats are hinged in front so that they may be tilted forward when the swing is not in use. This will prevent snow, rain or dirt from getting into the seats. Although not shown, the seats are fitted with seat belts to keep the riders from falling off. The seats are so designed that they can slide forward and backward, depending on the size of the riders, and locked in position so that the riders can have a firm grasp of the handgrips 10 on the handle frame while their feet are firmly placed on the footrest. This is not shown on the drawings.

Because of the offset position of pin 3, each handle frame will be at different sloping positions when connected. Some persons will be pushing while the others will be pulling. This pushing and pulling on the handles, which are attached the connecting rods and knuckle linkages to the crankpin, will cause a translation of forces and enable the riders to move in a circular direction about the centre shaft.

Although not shown, all the pins and split pins will be chained while the outer chain ends riveted on to the areas close to where they are used so that the pins are easily located and available for assembly.

Although the present invention shows four riders, an additional cross beam can be used for allowing six riders to use the swing at the same time. These cross beams must be spaced equally around the centre shaft to maintain an even balance around. By having more persons to drive the swing, the effort will be significantly reduced. Also the amount of support legs 19 can be increased to six or eight to give a more uniform distribution of the unit's weight to the ground/mounting floor.

Many of the various structural elements of the present invention could be made of any suitably rigid low-cost material. The two main seating beams can be made from molded polyethylene or polystyrene hollow sections of quadrangular cross-section; which is rugged, reliable and resilient to the weather.

Although it is desirable to have the parts of the assembly made from material that are not prone to rusting, it is not the intention of the inventor to compromise safety of the riders in any which way. As such, the centre shaft 35 should be made from metal of high strength and should be resilient to bending forces. Metals such as chrome-plated hollow section mild steel, stainless steel, aluminum or galvanized material can be used. Although many of the parts can be made from resilient polymeric material such as molded polystyrene, in some of the exposed mild steel areas, rubberized coating can be used to prevent rusting.

With respect to the above description then, is it realized that the present disclosure has been made by way of example and should not limit the scope of the invention. Changes in details of the optimum relationships for the parts of the invention, to include variations in the size, materials, shape, form, function and manner of operation, assembly and use, are deemed readily obvious to those skilled in the art.

It is understood that various omissions, modifications, substitutions and changes in the forms and structural details of the apparatus illustrated and in its operation, can be made by those skilled in the art, without departing from the spirit or essential attributes thereof. As such, reference should be made to the claims rather that the foregoing specification, as indicating the scope of the invention.

I claim:

1. An amusement swing apparatus assembly for rotating its riders in a horizontal plane, comprising of:

a vertically extending cylindrical main centre post with an upper end and a lower end, having said lower end fixed to a flat base plate which is anchored to a floor surface;

a stabilizing flange welded onto said main post at a predetermined position substantially between midpoint thereabout and said lower end and is disposed generally horizontal and parallel to said floor surface thereof, said flange mounted substantially coaxially to said main post and having at least four equally spaced bolt holes on a predetermined bolt hole circle thereon;

a stationary crank fixedly mounted to the upper end of said main post and essentially made up of a crank arm that is substantially horizontal to said floor surface and a vertical crank pin whose axis is offset from the axis of said main post;

four stabilizing legs with upper ends and lower ends, having said upper ends attached to said stabilizing flange of said main post while said lower ends are anchored to said floor surface thereof, said legs extends radially outwardly from said stabilizing flange;

two perpendicularly lapped beams which are coplanar and having an upper side and an underside, said beams forming a junction where they intersect, said junction having a shaped flat plate used for reinforcement mounted on said upper side of said lapped beams, said junction having a hole therethrough at a centre thereof passing through said junction and said flat reinforcement plate, bore of said hole is substantially larger than the outside diameter of said main post with said main post passing centrally therethrough, said lapped beams thus having four radially extending free ends thereof;

a centre support structure having an upper end and a lower end;

four obliquely mounted braces with upper ends and lower ends, having said upper ends fixed to the underside of said extending ends of the lapped beams while said lower ends are secured to the lower end of said centre support structure;

four bucket seats for riders to sit on, facing inward towards the main post and mounted on said lapped beams at said extending ends thereof;

actuator means which comprises of four handle frames, four connecting rods and four knuckle linkages, said handle frames having top and bottom ends, said bottom ends are hinged onto the extending ends of said lapped beams, substantially in front of said seats, said connecting rods having upper ends and lower ends, said upper ends connected to said top ends of said handle frames, said knuckle linkages having first and second ends, said first ends hinged to said lower end of said connecting rods while the second ends are connected to said vertical crank pin;

one upper and one lower flanged mounted type ball bearings having inner and outer rings, said inner rings have at least two setscrews while the outer rings are fixed to the flanges thereof, said flanges have at least two equally spaced bolt holes;

four footrests fixed to and depending substantially vertically downwards from said extending ends of the lapped beams at a predetermined position thereabout front of said seats;

anchoring means which comprises of spike nails for mounting the swing outdoor in a lawn, rawlbolts for mounting onto a concrete floor or coach screws to mount onto a wooden floor surface;

whereupon rotating motion is initiated and propagated by translation of forces imparted by the pulling and pushing on the handles by the riders.

2. An amusement swing apparatus assembly as in claim 1, wherein said main post is made from cold drawn hollow metal tubing.

3. An amusement swing apparatus assembly as in claim 1, wherein said base plate is a flange welded integrally to a boss, said boss is essentially a cylindrical socket welded concentrically to said flange and depends vertically upwards, said flange having at least four equally spaced bolt holes on a predetermined bolt hole circle, said holes having said anchoring means passing therethrough fixing said flange to said floor surface thereof, said boss is closely fitting and immovably mounted to said lower end of the main post.

4. An amusement swing apparatus assembly as in claim 1, wherein said lapped beams are of hollow rectangular cross-section for improved cantilever strength and reduced weight, said lapped beams are made from suitable rigid and resilient polymeric material, said lapped beams are substantially parallel to said floor surface thereof.

5. An amusement swing apparatus assembly as in claim 1, wherein said stabilizing legs are made from hollow metal tubing and are of an expanded S-shaped formation having an upper region, a middle region and a lower region, said upper region having first and second ends and runs substantially horizontal with said first ends flattened and having bolt holes, said middle region gradually sloping downwards and substantially outwards from said second ends of the upper region, said lower region rest substantially horizontally flat on the floor surface and have spaced drilled holes which are substantially diametrically vertical to said floor surface, said drilled holes have said anchoring means passing therethrough fixing said legs to the floor surface.

6. An amusement swing apparatus assembly as in claim 1, wherein the combination of said lapped beams with said mounted seats connected together with said centre support structure to which are mounted said upper and lower bearings and further assembled with said oblique braces herein defines the rotating assembly structure.

7. An amusement swing apparatus assembly as in claim 1, wherein said crank arm is a flat cam shaped plate which has a large end and a small end, said crank pin is welded to said small end and depends vertically upwards while a boss is integrally welded to said large end, said boss is essentially a cylindrical socket and is disposed vertically downwards from said crank arm, said boss is immovably mounted to the upper end of said main post.

8. An amusement swing apparatus assembly as in claim 1, wherein said footrests having different levels suitable for riders of different sizes and used by the seated riders for mounting and dismounting the swing, to rest their feet for comfort and also to assist the riders to have the advantage to drive the swing.

9. An amusement swing apparatus assembly as in claim 1 wherein said centre support structure is made up of four vertical support members coupled to a rotatable flange at the lower end thereof, said support members are made from hollow metal tubing and having upper ends and lower ends, said support members having a pair of mirror-imaged shaped brackets integrally welded one on each end respectively, said brackets are substantially oblong shaped in plan and having inner and outer ends which are semicircular, said outer ends are welded to said vertical support members while said inner ends have bolts holes and are extending radially inward towards the main post, said brackets at the upper ends of said support members are fastened to the underside of said lapped beams with bolts that passes through the lapped beams and said shaped reinforcement plate while the brackets at the lower ends of said support members are bolted to said rotatable flange at the lower end thereof, said rotatable flange having a hole in the centre thereof with a predetermined bore for the main post to pass through and is mounted substantially coaxially with the main post, said rotatable flange having four equally spaced bolt holes on a predetermined bolt hole circle.

10. An amusement swing apparatus assembly as in claim 1, wherein said oblique braces are made from hollow metal tubing having their upper and lower ends flattened and having bolt holes, said upper ends are bolted to the underside of said lapped beams at a position substantially beneath said bucket seats while the lower ends are bolted to said rotatable flange at said lower end of the centre support structure.

11. An amusement swing apparatus assembly as in claim 1, wherein said handle frames having transversely mounted handles which are essentially metal rods passing substantially concentrically through holes at said top ends of said handle frames, said handles having first and second ends and having handgrips made from hard polymeric material coaxially fitted onto both ends, said handle frames having a set screw used to fix said handles so that said handgrips are equally spaced from the handle frames, said handle frames are mounted so that said handles are within manual grasp of the seated riders.

12. An amusement swing apparatus assembly as in claim 1, wherein said connecting rods having rings welded substantially vertically at said upper ends and yokes with openings vertically disposed welded at said lower ends, wherein said rings are hinged at said top ends of said handle frames.

13. An amusement swing apparatus assembly as in claim 1, wherein said knuckle linkages are essentially made up of two rings and a short rod, said rod having a first end and a second end, one ring is welded to said first end of said short rod and is substantially vertically while the other ring is welded substantially horizontally onto said second end of the short rod, said knuckle linkages having said vertical rings hinged to said yokes at the lower ends of said connecting rods while said horizontal rings are hinged onto said vertical crank pin.

14. An amusement swing apparatus assembly as in claim 1, further including a spacer ring placed between said rotatable flange of said centre support structure and said stabilizing flange on said vertical main post, said ring is coaxially mounted to said main post.

15. An amusement swing apparatus assembly as in claim 1, wherein the inner ring of said upper bearing is coaxially mounted to said main post and locked to said main post with said set screws, said bearing flange of said upper bearing is bolted to said shaped reinforcement plate.

16. An amusement swing apparatus assembly as in claim 1, wherein the inner ring of said lower bearing is coaxially mounted to said main post and locked to said main post with said set screws, said bearing flange of said lower bearing is bolted onto said rotatable flange at said lower end of the centre support structure.

17. An amusement swing apparatus assembly as in claim 1, wherein said bucket seats are made from polymeric material, said seats are hinged onto the extending ends of said lapped beams so that they can be tilted forward, said seats having suitable seat belts, said seats having sliding mechanism to allow seats to be moved forward and backward and said seats having suitable locking fixtures.

18. An amusement swing apparatus assembly as in claim 1, further consisting of a spacer ring which is first mounted coaxially onto said vertical crank pin thereby raising the lower ends of the said knuckle linkages to prevent said connecting rods or said knuckle linkages to come in contact with said crank arm when the swing is rotating.

* * * * *